US010113439B2

(12) United States Patent
Cortequisse

(10) Patent No.: US 10,113,439 B2
(45) Date of Patent: Oct. 30, 2018

(54) INTERNAL SHROUD FOR A COMPRESSOR OF AN AXIAL-FLOW TURBOMACHINE

(71) Applicant: Techspace Aero S.A., Herstal (Milmort) (BE)

(72) Inventor: Jean-François Cortequisse, Heers (BE)

(73) Assignee: SAFRAN AERO BOOSTERS SA, Herstal (Milmort) (BE)

( * ) Notice: Subject to any disclaimer, the term of this patent is extended or adjusted under 35 U.S.C. 154(b) by 354 days.

(21) Appl. No.: 14/923,483

(22) Filed: Oct. 27, 2015

(65) Prior Publication Data

US 2016/0138413 A1 May 19, 2016

(30) Foreign Application Priority Data

Nov. 18, 2014 (BE) ..... 2014/0820

(51) Int. Cl.
*F01D 11/12* (2006.01)
*F01D 9/04* (2006.01)
(Continued)

(52) U.S. Cl.
CPC ..... *F01D 11/122* (2013.01); *F01D 9/041* (2013.01); *F01D 9/042* (2013.01); *F01D 9/06* (2013.01); *F01D 11/001* (2013.01); *F05D 2220/30* (2013.01); *F05D 2240/11* (2013.01); *F05D 2240/12* (2013.01); *F05D 2300/40* (2013.01); *F05D 2300/603* (2013.01)

(58) Field of Classification Search
CPC ..... F01D 11/122; F01D 11/001; F01D 9/042; F01D 9/06; F01D 9/041; F05D 2300/40; F05D 2300/603; F05D 2240/11; F05D 2240/12; F05D 2220/30
See application file for complete search history.

(56) References Cited

U.S. PATENT DOCUMENTS 2,410,588 A * 11/1946 Phelan ..... F01D 5/3038 415/173.6
2,771,622 A * 11/1956 Thorp, II ..... F01D 9/044 415/194

(Continued)

OTHER PUBLICATIONS

Search Report dated Jul. 14, 2015 for BE 2014/0820.

*Primary Examiner* — Dwayne J White
*Assistant Examiner* — Adam W Brown
(74) *Attorney, Agent, or Firm* — James E. Walton

(57) ABSTRACT

The present application relates to a segmented inner shroud of a low-pressure compressor for an axial-flow turbine engine. The shroud includes an axial tubular wall, and a row of apertures formed in the axial wall. Each aperture has opposing edges situated to either side of a stator vane positioned in the aperture for the purpose of its attachment. The axial wall includes a radial flange which passes through the apertures in the circumferential direction of the shroud, so as to form a mechanical link between the opposing edges of the apertures. This mechanical seal permits the opposing edges to be joined together through each aperture, which improves the rigidity and the sealing. The shroud exhibits an E-shaped profile forming a sandwich structure with the annular sealing fins of the rotor, or sealing lips. The present application also relates to a method for the assembly of stator vanes abutting radially against the transverse radial flange.

19 Claims, 3 Drawing Sheets

(51) Int. Cl.
*F01D 9/06* (2006.01)
*F01D 11/00* (2006.01)

(56) References Cited

U.S. PATENT DOCUMENTS 2,962,809 A * 12/1960 Short ..... F01D 11/122 29/445
3,836,282 A * 9/1974 Mandelbaum ..... F01D 9/042 415/209.4
4,295,785 A * 10/1981 Lardellier ..... F01D 11/02 277/414
4,710,097 A * 12/1987 Tinti ..... F01D 25/246 415/138
5,201,847 A * 4/1993 Whidden ..... F01D 9/023 415/177
5,722,813 A * 3/1998 Li ..... F04D 29/083 415/208.1
6,409,472 B1 * 6/2002 McMahon ..... F01D 5/3023 415/119
6,543,995 B1 * 4/2003 Honda ..... F01D 9/041 415/189
6,830,427 B2 * 12/2004 Lafarge ..... F01D 5/288 415/115
7,147,434 B2 * 12/2006 Mons ..... F01D 9/042 29/458
7,311,495 B2 * 12/2007 Ashley ..... F01D 5/26 415/209.4
8,636,466 B2 * 1/2014 Cortequisse ..... F01D 9/042 415/138
8,966,756 B2 * 3/2015 Feigleson ..... F01D 9/042 29/458
9,771,815 B2 * 9/2017 Remy ..... F01D 25/246
2006/0013685 A1 1/2006 Ellis et al.

* cited by examiner

INTERNAL SHROUD FOR A COMPRESSOR OF AN AXIAL-FLOW TURBOMACHINE

This application claims priority under 35 U.S.C. § 119 to Belgium Patent Application No. 2014/0820, filed 18 Nov. 2014, titled "Internal Shroud for a Compressor of an Axial-Flow Turbomachine," which is incorporated herein by reference for all purposes.

BACKGROUND

1. Field of the Application

The present application relates to axial-flow turbine engines. More specifically, the present application relates to the inner shrouds that are connected to a row of stator vanes.

2. Description of Related Art

An inner shroud is known, which permits the primary flow of an axial-flow turbine engine to be defined by constituting an annular wall which delimits the interior of the fluid stream. Thanks to its external surface, it helps to guide the flow in the course of its expansion in a turbine, or its compression in a compressor.

In a conventional manner, an inner shroud may be mounted on the inner extremities of vanes disposed in a single annular row, which are in turn attached to an external casing. The shroud has recesses for the introduction of the extremities for the attachment of the shrouds.

The inner shroud also has the aim of ensuring a seal with the rotor around which it is positioned. For this purpose, it exhibits a layer of an abradable material interacting by abrasion with sealing lips formed on the exterior of the rotor. In operation, the sealing lips come into close contact with the abradable material, where they possibly create circular incisions, so that dynamic sealing is assured.

Document EP2075414A1 discloses a compressor for an axial-flow turbine engine comprising rectifiers equipped with segmented inner shrouds. Each inner shroud comprises a tubular wall, in which rows of apertures are provided. The latter permit the introduction of the vane feet that are used for the attachment between the shroud and the vanes. Each aperture exhibits a lip, which prolongs its contour radially, and fins join the lips of the neighbouring apertures, the assembly making it possible to add rigidity to the shroud. However, the flexural rigidity of the shroud, in particular that of its segments, remains limited. In the event of loading, most of the forces are taken up by the U-shaped branches of the shroud. In the event of vibrations, the openings are able to open further around the joints surrounding the vanes, which compromises the sealing.

Although great strides have been made in the area of axial-flow turbomachines, many shortcomings remain.

DETAILED DESCRIPTION OF THE PREFERRED EMBODIMENT

Figure 1:
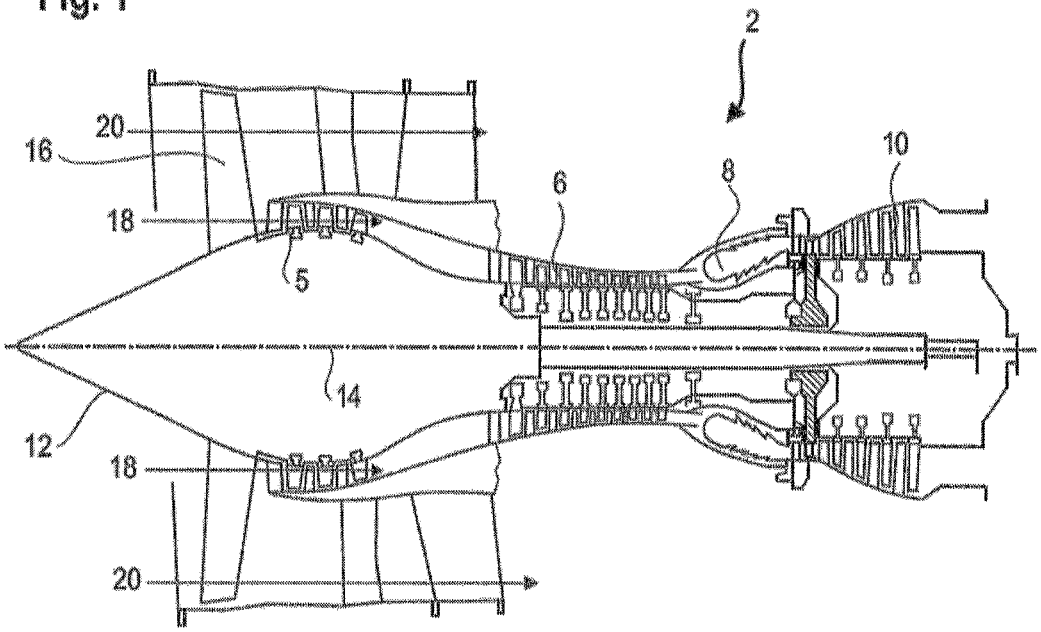
FIG. 1 depicts an axial-flow turbine engine according to the present application.

The present application aims to solve at least one of the problems posed by the prior art. More specifically, the present application has as its object to add rigidity to an inner shroud or a segment of an inner shroud attached to stator vanes. The present application also has as its object to improve the rigidity of an assembly including a shroud and vanes attached in apertures formed in the shroud. The present application also has as its object to improve the sealing of a shroud or a shroud segment.

The present application has as its object a shroud or a shroud segment for an axial-flow turbine engine, in particular for a compressor, the shroud or the shroud segment comprising a circular or semi-circular wall, of which the profile extends essentially axially, and a circular or semi circular radial flange extending radially from the wall towards the interior, the flange exhibiting a circular or semi-circular surface, of which the profile extends essentially radially, said surface exhibiting areas of roughness.

The present application also has as its object an inner shroud or a segment of an inner shroud for an axial-flow turbine engine, in particular for a compressor, the shroud or the shroud segment comprising: a circular or semi-circular wall, of which the profile extends essentially axially, and a row of apertures formed in the axial wall, each aperture exhibiting opposing edges intended to be disposed laterally to either side of a stator vane positioned in said aperture for the purpose of its attachment, characterized in that the wall comprises at least one radial flange which passes through the apertures in the circumferential direction of the shroud or of the shroud segment, so as to form a mechanical link within each aperture for the purpose of connecting together the opposing edges thereof.

According to an advantageous embodiment of the present application, each aperture extends essentially axially and each radial flange extends radially towards the interior from the wall, and continues all the way round the shroud or for the entire width of the shroud segment in the direction of alignment of the row of apertures.

According to an advantageous embodiment of the present application, the shroud or the shroud segment comprises at least one strip of an abradable material, each radial flange extending further radially towards the interior than each layer of abradable material.

According to an advantageous embodiment of the present application, the shroud or the shroud segment comprises a plurality of radial flanges which each pass through the apertures, each strip of abradable material possibly being disposed axially between two radial flanges.

According to an advantageous embodiment of the present application, the axial wall and each radial flange are integrally formed in a single piece, the axial wall and each of the radial flanges possibly being made from a polymer, such as a composite material having an organic matrix.

According to an advantageous embodiment of the present application, the radial flange is a transverse radial flange which passes through the apertures, the shroud or the shroud segment comprising an upstream radial flange disposed upstream of the apertures, and a downstream radial flange disposed downstream of the apertures, the upstream flange and the downstream flange preferably axially delimiting the axial wall.

According to an advantageous embodiment of the present application, at least one radial flange or each radial flange comprises at least one surface having areas of roughness, said surface being generally perpendicular to the axis of revolution of the shroud or of the shroud segment.

According to an advantageous embodiment of the present application, the areas of roughness form a pattern that is repeated on substantially the entire face of the corresponding radial flange.

According to an advantageous embodiment of the present application, the areas of roughness exhibit the form of teeth, possibly triangular, each tooth extending for the majority or for the whole of the radial height of the associated radial flange.

According to an advantageous embodiment of the present application, the radial flange comprises portions, each of which closes off an aperture, possibly in the direction of alignment of the row of apertures.

According to an advantageous embodiment of the present application, the radial height of at least one radial flange or each radial flange is greater than the radial height of each annular fin.

According to an advantageous embodiment of the present application, at least one aperture or each aperture extends for the majority of the axial length of the axial wall. The aperture row may comprise at least three apertures.

According to an advantageous embodiment of the present application, the wall comprises a radial flange disposed axially at the center of the apertures, where the wall comprises a plurality of radial flanges distributed axially on the apertures.

The present application also has as its object a method for the assembly of a stator vane to an inner shroud or to a segment of an inner shroud for an axial-flow turbine engine, the method comprising the following steps: (a) provision of one or a plurality of stator vanes, each stator vane including an inner radial extremity; (b) provision of an inner shroud or a segment of an inner shroud having a row of apertures; (c) positioning of each extremity of the stator vane in an aperture; (d) attachment of each vane extremity in the associated aperture, characterized in that the shroud or the shroud segment comprises at least one circular or semi-circular radial flange passing through the apertures, and in that, during the positioning step (c), each vane extremity is in abutment against the radial flange, the inner shroud or the segment of an inner shroud possibly being in accordance with the present application.

According to an advantageous embodiment of the present application, during the positioning step (c), each vane extremity passes through the associated aperture.

According to an advantageous embodiment of the present application, during the positioning step (c), each vane extremity abuts axially and/or abuts radially against the radial flange, each vane extremity possibly comprising means of attachment.

According to an advantageous embodiment of the present application, the provision step (b) comprises the production of the shroud or of the shroud segment by additive manufacturing.

According to an advantageous embodiment of the present application, the method further comprises a step (e) for the implementation or realization of sealing joints in the apertures around the stator vanes.

The present application also has as its object a turbine engine comprising a rotor and an inner shroud around the rotor or a segment of an inner shroud adopting the form of the rotor, characterized in that the shroud or the shroud segment is in accordance with the present application; and/or the turbine engine comprises a stator vane and an inner shroud or a segment of an inner shroud assembled according to a method of assembly, characterized in that the method is in accordance with the present application.

According to an advantageous embodiment of the present application, the rotor includes annular fins interacting in a sealed manner with the shroud or the shroud segment, the annular fins of the rotor each being situated at a distance axially from each radial flange of the shroud or the shroud segment.

According to an advantageous embodiment of the present application, at least one radial flange covers one of the annular fins radially and circularly.

According to an advantageous embodiment of the present application, at least one radial flange or each radial flange comprises areas of roughness which are formed on the majority of the radial height of the revolution profile of one of the annular fins of the rotor disposed next to the associated radial flange.

According to an advantageous embodiment of the present application, the radial clearance between each radial flange and the rotor is greater than the radial clearance between the annular fins and the shroud or the shroud segment.

According to an advantageous embodiment of the present application, the rotor comprises N annular fins, the shroud or the shroud segment comprising at least N+1 radial flanges, preferably at least 2×N radial flanges, forming N pairs of radial flanges which adjoin the upstream and downstream surfaces of each annular fin.

According to an advantageous embodiment of the present application, each aperture comprises a sealing joint intended to surround a stator vane disposed in said aperture, the sealing joint being in contact with the radial flange which passes through said aperture, the joint preferably being realized in an elastomeric material such as silicone.

According to an advantageous embodiment of the present application, at least one stator vane or each stator vane comprises the form of a radial step abutting axially and/or abutting radially against the radial flange or one of the radial flanges.

According to an advantageous embodiment of the present application, at least one stator vane or each stator vane comprises a slot into which the radial flange or one of the radial flanges of the shroud engages, and/or the radial flange or one of the radial flanges comprises slots into which the stator vanes engage.

According to an advantageous embodiment of the present application, at least one stator vane or each stator vane comprises means of attachment such as means of radial retention.

According to an advantageous embodiment of the present application, the annular fins of the rotor and the radial flanges of the inner shroud form a sandwich structure.

According to an advantageous embodiment of the present application, each radial flange exhibits a revolution profile which extends essentially radially, and the annular fins each comprise a revolution profile which extends essentially radially, each flange profile extending for the majority of the radial height of each profile of a neighboring annular fin.

The radial flange makes it possible to form a bridge which spans each aperture. The flange thus makes it possible to connect the opposing edges of the apertures in such a way as to join the edges together. This mechanical seal makes it possible to connect the opposing edges through each aperture, so as to prevent them from spreading apart or moving closer together in spite of the absence of material in the apertures.

In parallel, the present application makes it possible to improve the sealing between a shroud or a shroud segment having apertures in which stator vanes are attached. The present application thus proposes a shroud or a shroud segment that is both light, rigid, and economical to produce.

In the following description, the terms interior or inner and exterior or external refer to a position in relation to the axis of rotation of an axial-flow turbine engine. The axial direction corresponds to the direction along the axis of rotation of the turbine engine. The lateral direction extends around the circumference.

FIG. 1 depicts an axial-flow turbine engine in a simplified manner. In this particular case, the engine is a turbofan engine. The turbofan engine 2 comprises a first level of compression, known as the low-pressure compressor 5, a second level of compression, known as the high-pressure compressor 6, a combustion chamber 8 and one or a plurality of levels of turbines 10. In operation, the mechanical output of the turbine 10 transmitted via the central shaft as far as the rotor 12 sets the two compressors 5 and 6 in motion. The latter include a plurality of rows of rotor blades associated with rows of stator vanes. The rotation of the rotor about its axis of rotation 14 thus makes it possible to generate an air flow and to compress the latter progressively as far as the entrance to the combustion chamber 8. Reduction means may be used to increase the speed of rotation transmitted to the compressors.

An air intake fan, commonly referred to as a fan or blower 16, is coupled to the rotor 12 and generates an air flow which divides into a primary flow 18 passing through the various aforementioned levels of the turbine engine, and a secondary flow 20 passing through an annular duct (partially depicted) along the machine before subsequently rejoining the primary flow at the outlet from the turbine. The secondary flow may be accelerated so as to generate a thrust reaction. The primary flow 18 and the secondary flow 20 are annular flows, and they are channelled through the casing of the turbine engine. For this purpose, the casing has cylindrical walls or shrouds which may be inner and external.

Figure 2:
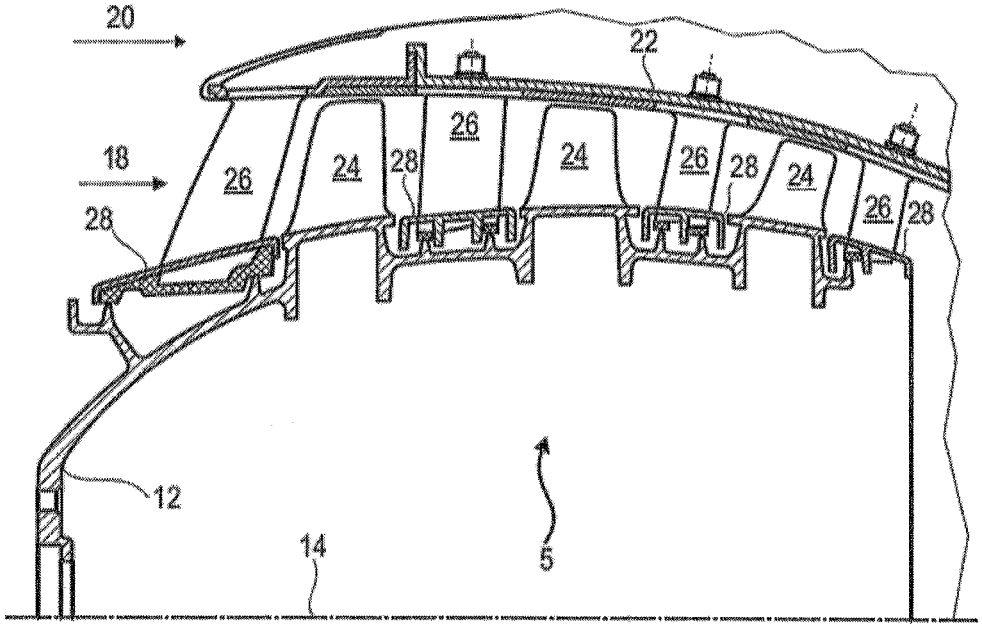
FIG. 2 is a drawing of a compressor for a turbine engine according to the present application.

FIG. 2 is a sectional view of a compressor for an axial-flow turbine engine such as that depicted in FIG. 1. The compressor may be a low-pressure compressor 5. The rotor 12 comprises a drum having an annular external wall which supports a plurality of rows of rotor blades 24, in this particular case being three rows.

The low-pressure compressor 5 comprises a plurality of rectifiers, in this particular case being four in number, which each contain a row of stator vanes 26. The rectifiers are associated with the blower or with a row of rotor blades in order to rectify the flow of air, so as to convert the flow velocity into static pressure.

The stator vanes 26 extend essentially radially from an external casing 22, and may be attached there with the help of a pin. The casing 22 then forms an external support for the different rows. The compressor 5 likewise comprises inner shrouds 28 which are attached to the radially inner extremities of the stator vanes 26. The inner shrouds 28 permit the primary flow 18 to be guided and defined. They also provide sealing with the rotor 12 in order to prevent the recirculation of air from reducing the rate of compression of the compressor 5, and limiting the output of the turbine engine. Each shroud 28 may form a ring with a single turn, or may be segmented in an angular fashion.

Figure 3:
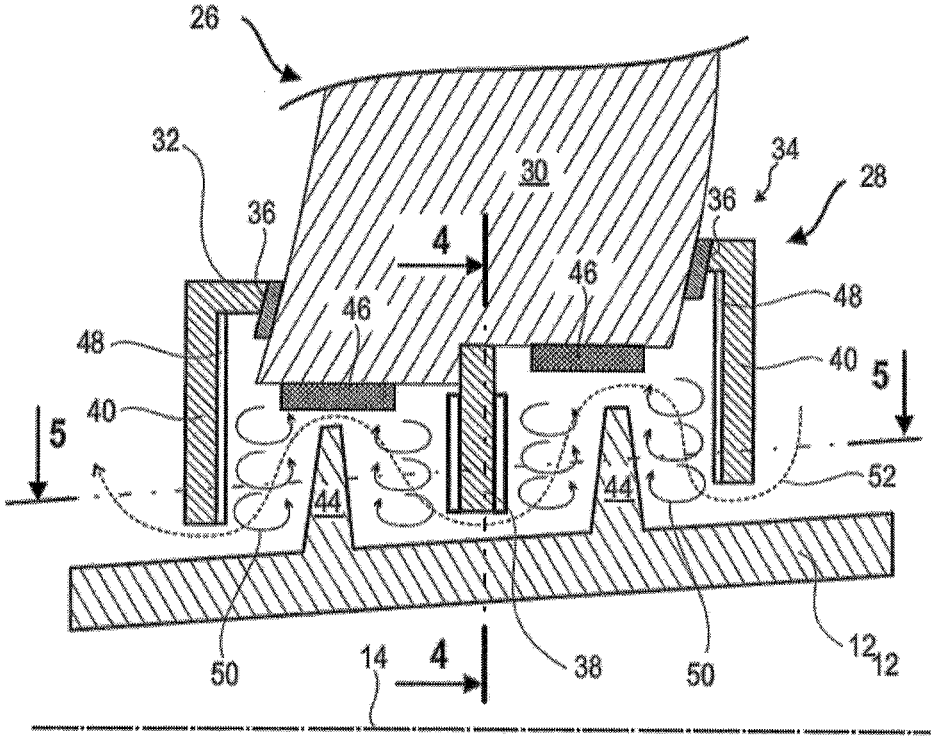
FIG. 3 illustrates a portion of a compressor according to the present application.

FIG. 3 depicts a portion of the compressor such as that depicted in FIG. 2. A portion of the rotor 12, an inner radial extremity 30 of the stator vane 26 and an inner shroud 28, which is attached thereto, are visible here. The inner shroud 28 could be segmented.

The shroud 28 exhibits a revolution profile having a portion extending essentially axially and which generates an axial wall 32. The axial wall 32 may be generally tubular and may be substantially inclined in relation to the axis of rotation 14 of the turbine engine; the latter may coincide with the general axis of symmetry 14 of the shroud 28.

The shroud 28 exhibits a series of apertures 34 disposed in a single annular row. These apertures 34 are traversed by the extremities 30 of the vanes 26 in order to suspend the shroud 28 there. Each aperture 34 has opposing edges 36 in the direction of the row of apertures 34, these edges 36 being positioned facing towards the surfaces of the associated vane 26. One is situated next to the intrados surface of the vane, and the other is situated next to the extrados surface. The edges 36 may generally be mating edges; one being concave, and the other being convex.

The shroud 28 comprises in addition at least one radial flange 38, which extends radially towards the interior from the axial wall 32. The shroud 28 may comprise a plurality of radial flanges 38, each of which cuts the apertures 34. These radial flanges may be parallel and may be distributed axially across the apertures.

The shroud 28 may comprise at least three radial flanges, these being an upstream radial flange 40, a downstream radial flange 42, and a transverse radial flange 38 which passes through the apertures 34, or a central radial flange 38. The transverse radial flange 38 is disposed axially between the upstream flanges 40 and the downstream flanges 42. The shroud may exhibit an E-shaped or comb-like profile.

The rotor 12, in particular its wall, has annular fins 44, also referred to as "sealing lips". These extend radially and interact with the shroud 28 in a sealed manner. They may interact by abrasion with layers of abradable material 46, where they dig furrows in the event of contact. The expression abradable material is used to denote a friable material in the event of contact. The layers of abradable material 46 may be applied to the extremities of vanes 30, and/or to the axial wall 32. The layers of abradable material 46 and the radial flanges (38; 40; 42) form a sandwich structure.

The radial flanges (38; 40; 42) may be associated in pairs in order to frame each annular fin 44 of the rotor 12, possibly individually. Each radial flange (38; 40; 42) comprises a revolution profile which extends essentially radially, each flange profile extending for the majority of the radial height of each profile of the neighbouring radial flange. Each fin profile (38; 40; 42) extends for the majority of the radial height of the profile of the neighbouring annular fins 44.

In order to improve the dynamic sealing of the turbine engine, the faces of the radial flanges (38; 40; 42) facing towards the annular fins 44 being covered by areas of roughness 48 which amplify the turbulences 50, or swirls 50 to prevent recirculation 52.

Figure 4:
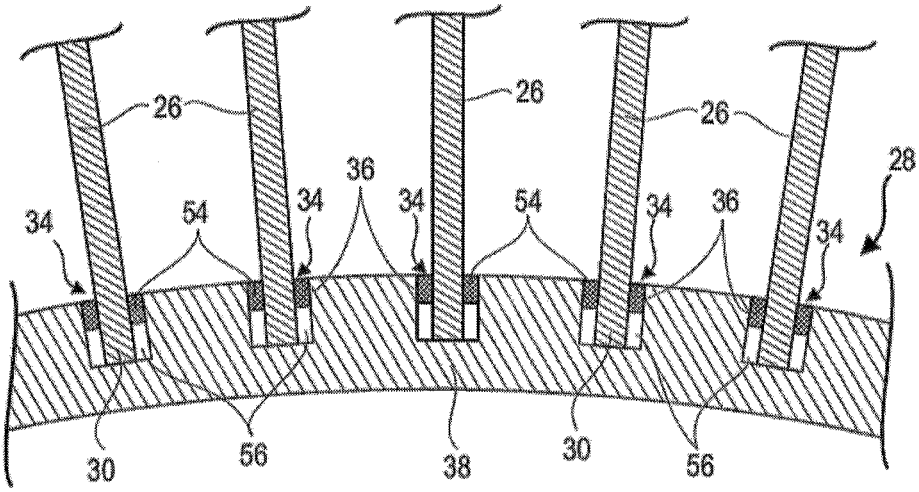
FIG. 4 outlines a section of the portion of a compressor in the axis 4-4 marked in FIG. 3 according to the present application.

FIG. 4 depicts a section of the shroud 28 and of the stator vanes 26 according to the axis 4-4 marked in FIG. 3. The sectional plane passes through the radial flange 38 which passes through the apertures 34. The shroud could be formed by segments of the shroud which would be placed end-to-end so as to form a circle.

The vanes 26 extend radially from the shroud 28 and pass through the apertures 34. Their radial extremities 30 abut radially against the radial flange 38. Each vane extremity 30 has a radial abutment surface which interacts with a corresponding abutment surface of a niche. Sealing joints 54 extend radially into the apertures 34 and pass through them, and they come into contact with the radial flange 38. The bases of slots, or the abutment surfaces of the slots, are at a distance from the joints 54 and/or from the axial wall.

The radial flange 38 not only joins together all the apertures 34, but it also connects all the opposing edges 36 one to the other by passing through the apertures 34. It forms a reinforcement strut which, in each aperture 34, blocks the opposing edges 36. The radial flange 38 exhibits an arched form and a profile with niches. It includes a series of steps forming slots 56, in which the extremities 30 of vanes 26 are located. These slots 56 may be a point of attachment for the vanes 26, for example by gluing or with the help of attachment plates (not illustrated). For this purpose, the extremities 30 may comprise attachment orifices (not illustrated). Within each aperture 34, the radial flange 38 connects the opposing edges 36. This configuration adds rigidity to the shroud 28 and prevents it from flexing at the level of the apertures 38, so that the risks of detachment at the level of the joints 54 are reduced.

Figure 5:
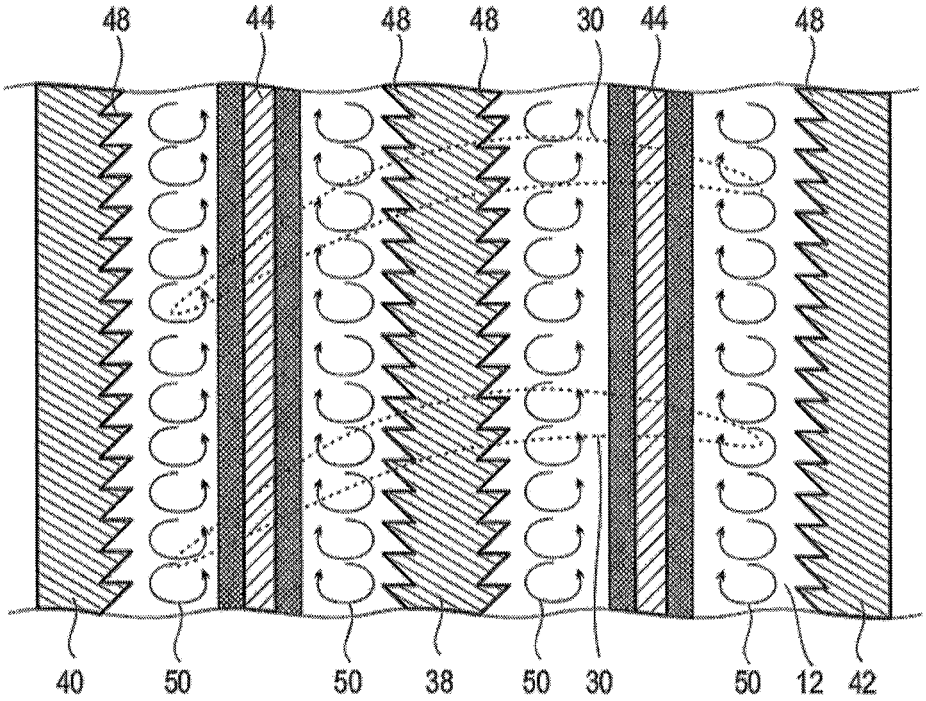
FIG. 5 shows a section of the portion of a compressor in the axis 5-5 marked in FIG. 3 according to the present application.

FIG. 5 depicts a section according to the axis 5-5 marked in FIG. 3. The section shows a slice through a compressor between the rotor 12 and an inner shroud, viewed from the exterior. The location of the vane extremities 30 is illustrated.

The areas of roughness 48 may include dimples and/or protrusions. They may include furrows and ridges forming an alternation. They extend radially and are possibly perpendicular to the axis of rotation of the turbine engine. The assembly may form a striated annular surface. The areas of roughness 48 may have the form of triangular teeth and may exhibit a generally saw-toothed profile.

The areas of roughness 48 are formed in front of the sealing lips 44, preferably on either side. The pattern may be formed, depending on the circumference, all the way along the radial flanges (38; 40; 42); or all the way around. Thanks to the areas of roughness 48, the radial flanges (38; 40; 42) induce swirls 50 in the air driven by the rotor 12.

Figure 6:
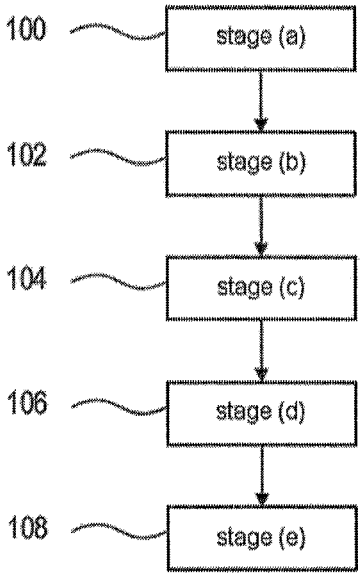
FIG. 6 is a diagram of the method for the assembly of a stator vane to an inner shroud or to a segment of an inner shroud according to the present application.

FIG. 6 depicts a diagram of a method for the assembly of a stator vane on a shroud, the shroud being capable of being segmented.

The method may comprise the following stages or steps, possibly performed in the order indicated below:

(a) provision of one or a plurality of stator vanes 100, each stator vane including an inner radial extremity, optionally with means of attachment;

(b) provision of an inner shroud or a segment of an inner shroud 102 comprising a row of apertures and a circular or semi-circular radial flange passing through the apertures by passing through them from edge to edge;

(c) positioning 104 of each extremity of a stator vane in an aperture by bringing each vane extremity into abutment against the radial flange;

(d) attachment 106 of each vane extremity in the associated aperture;

(e) implementation or realization 108 of sealing joints in the apertures around the stator vanes, so as to permit sealing between the shroud and the stator vanes.

The provision step (b) 102 may comprise the additive manufacturing of the shroud or of the shroud segment. The shroud or each segment may be integrally formed in a single piece and may be made from a polymer, for example from a composite material with fibres, possibly having a length of less than 10 mm.

The positioning step (c) 104 may be performed by attaching the vanes to an external compressor casing. The shroud is then brought closer radially so that the inner extremities of the vanes are present in the apertures. The vane extremities enter into the apertures as a first step, and then pass through them. Finally, these extremities abut against a radial flange. The abutment is then axial and/or radial, which permits the relative position between the vane and the shroud to be improved. As a result, the joint realized or implemented in the course of the implementation or realization step (e) 108 is better positioned and/or better realized.

I claim:

1. An inner shroud or inner shroud segment for an axial-flow turbine engine, the shroud or the shroud segment comprising:

a circular or semi-circular wall, of which the profile extends essentially axially, and a row of apertures formed in the circular or semi-circular wall, each aperture exhibiting opposing edges intended to be disposed laterally to either side of a stator vane positioned in said aperture for the purpose of its attachment, wherein said wall comprises at least one radial flange which passes through the apertures in the circumferential direction of the shroud or of the shroud segment, so as to form a mechanical link within each aperture in order to join the opposing edges thereof, and at least one radial flange comprises at least one surface having areas of roughness forming a pattern that is repeated on substantially an entire face of the corresponding radial flange, said surface being generally perpendicular to an axis of revolution of the shroud or of the shroud segment.

2. The inner shroud or inner shroud segment of claim 1 wherein each aperture extends essentially axially and each radial flange extends radially towards the interior from the circular or semi-circular wall, and continues all the way round the shroud or for the entire width of the shroud segment in the direction of alignment of the row of apertures.

3. The inner shroud or inner shroud segment of claim 1 wherein the shroud or the shroud segment comprises at least one strip of an abradable material, each radial flange extending further radially inside than each layer of abradable material.

4. The inner shroud or inner shroud segment of claim 3 wherein the shroud or the shroud segment comprises a plurality of radial flanges which each pass through the apertures, each strip of abradable material being disposed axially between two radial flanges of said plurality.

5. The inner shroud or inner shroud segment of claim 1 wherein the circular or semi-circular wall and each radial flange are integrally formed in a single piece, the circular or semi-circular wall and each of the radial flanges being made from a composite material with an organic matrix.

6. The inner shroud or inner shroud segment of claim 1 wherein the radial flange is a transverse radial flange which passes through the apertures, the shroud or the shroud segment comprising an upstream radial flange disposed upstream of the apertures, and a downstream radial flange disposed downstream of the apertures, the flange upstream and the flange downstream axially delimiting the circular or semi-circular wall.

7. The inner shroud or inner shroud segment of claim 1 wherein the areas of roughness exhibit the form of teeth, each tooth extending for the majority or for the whole of the radial height of the associated radial flange.

8. A turbine engine comprising a rotor and inner shroud or an inner shroud segment, the inner shroud or the inner shroud segment comprising:

a circular or semi-circular wall, of which the profile extends essentially axially, and a row of apertures formed in the circular or semi-circular wall, each aperture exhibiting opposing edges intended to be disposed laterally to either side of a stator vane positioned in said aperture for the purpose of its attachment, wherein the circular or semi-circular wall comprises at least one radial flange which passes through the apertures in the circumferential direction of the shroud or of the shroud segment, and which touches the opposing edges of the apertures so as to form a mechanical link within each aperture in order to link the opposing edges thereof, and the shroud or the shroud segment comprises at least one strip of an abradable material, each or at least one radial flange extending further radially inside than each layer of abradable material.

9. The turbine engine of claim 8 wherein the rotor includes annular fins interacting in a sealed manner with the shroud or the shroud segment, the annular fins of the rotor each being located at a distance axially from each radial flange of the shroud or of the shroud segment.

10. The turbine engine of claim 9 wherein at least one radial flange covers one of the annular fins radially and circularly.

11. The turbine engine of claim 9 wherein at least one radial flange or each radial flange comprises areas of roughness which are formed on the majority of the radial height of the revolution profile of one of the annular fins of the rotor disposed next to the associated radial flange.

12. The turbine engine of claim 9 wherein the radial clearance between each radial flange and the rotor is greater than the radial clearance between the annular fins and the shroud or the shroud segment.

13. The turbine engine of claim 8 wherein each aperture comprises a sealing joint intended to surround a stator vane disposed in said aperture, the sealing joint being in contact with the radial flange which passes through said aperture, the joint being realized in an elastomeric material such as silicone.

14. The turbine engine of claim 8 wherein at least one stator vane or each stator vane comprises the form of a radial step abutting axially and abutting radially against the at least one or one of the radial flanges.

15. The turbine engine of claim 8 wherein at least one stator vane or each stator vane comprises a slot into which the at least one or one of the radial flanges of the shroud engages, and/or the radial flange or one of the radial flanges comprises slots into which the stator vanes engage.

16. An assembly method of a stator vane to an inner shroud or to an inner shroud segment for an axial-flow turbine engine, the method comprising the following steps:

(a) provision of a plurality of stator vanes, each stator vane including an inner radial extremity;

(b) provision of an inner shroud or an inner shroud segment having a row of apertures, the shroud or the shroud segment comprising at least one circular or semi-circular radial flange passing through the apertures;

(c) positioning of each inner radial extremity of a stator vane in an aperture, during the positioning step (c), each inner radial extremity comes in abutment against the radial flange;

and then after (d) attachment of each vane extremity in the associated aperture.

17. The method of claim 16 wherein during the positioning step (c), each inner radial extremity passes through the associated aperture, and the provision step (b) comprises the production of the shroud or of the shroud segment by additive manufacturing.

18. The method of claim 16 wherein the shroud or the shroud segment comprises at least one strip of an abradable material, each radial flange extending further radially towards the interior than each layer of abradable material, and wherein at least one radial flange comprises at least one surface having areas of roughness, said surface being generally perpendicular to the rotation axis of the turbine engine.

19. The method of claim 16 wherein it comprises in addition a step (e) for the implementation of sealing joints in the apertures around the stator vanes, and wherein during the positioning step (c), each inner radial extremity abuts axially and radially against the radial flange.

* * * * *